US007714244B1

(12) United States Patent
De Pedro

(10) Patent No.: US 7,714,244 B1
(45) Date of Patent: May 11, 2010

(54) BUTTON PANEL FOR ELEVATORS, LIFTS, AND SIMILAR MACHINERY

(76) Inventor: Marta Elena De Pedro, Avenida Del Libertador 336, Ciudad Autonoma De Buenos Aires (AR)

( * ) Notice: Subject to any disclaimer, the term of this patent is extended or adjusted under 35 U.S.C. 154(b) by 0 days.

(21) Appl. No.: 12/416,039

(22) Filed: Mar. 31, 2009

(51) Int. Cl.
*H01H 3/12* (2006.01)

(52) U.S. Cl. ..... 200/341; 187/395

(58) Field of Classification Search ..... 200/341; 187/395
See application file for complete search history.

(56) References Cited

U.S. PATENT DOCUMENTS

| | | | | |
|---|---|---|---|---|
| 5,477,942 | A * | 12/1995 | Shea et al. | 187/395 |
| 5,507,366 | A * | 4/1996 | Huang | 187/395 |
| 5,889,240 | A * | 3/1999 | Purosto et al. | 187/395 |
| 6,227,335 | B1 * | 5/2001 | Koeppe et al. | 187/414 |
| 6,502,668 | B1 * | 1/2003 | Chida et al. | 187/395 |
| 6,724,888 | B2 * | 4/2004 | Felder | 379/368 |
| 6,845,850 | B1 * | 1/2005 | Schneck | 187/395 |
| 7,152,715 | B2 * | 12/2006 | Meyer | 187/391 |
| 7,183,511 | B2 * | 2/2007 | Ikeda et al. | 200/314 |
| 7,404,471 | B2 * | 7/2008 | Felder et al. | 187/395 |
| 7,507,924 | B2 * | 3/2009 | Lorenzo Riera et al. | 200/314 |
| 7,562,748 | B2 * | 7/2009 | Stranieri et al. | 187/395 |
| 2003/0209415 | A1 * | 11/2003 | Ikeda et al. | 200/314 |
| 2003/0234169 | A1 * | 12/2003 | Iwakiri | 200/341 |
| 2004/0140190 | A1 * | 7/2004 | Searle et al. | 200/341 |
| 2004/0182687 | A1 * | 9/2004 | Tsubaki | 200/341 |
| 2005/0072661 | A1 * | 4/2005 | Katagiri | 200/341 |
| 2005/0145469 | A1 * | 7/2005 | Ikeda et al. | 200/314 |
| 2005/0173201 | A1 * | 8/2005 | Meyer | 187/395 |
| 2005/0224298 | A1 * | 10/2005 | Felder et al. | 187/395 |
| 2005/0224329 | A1 * | 10/2005 | Milo | 200/341 |
| 2005/0252725 | A1 * | 11/2005 | Felder et al. | 187/395 |
| 2006/0054421 | A1 * | 3/2006 | Ikeda | 187/395 |
| 2007/0045050 | A1 * | 3/2007 | Stranieri et al. | 187/247 |

* cited by examiner

*Primary Examiner*—Ross N Gushi
(74) *Attorney, Agent, or Firm*—Galbreath Law Offices, P.C.; John A. Galbreath

(57) ABSTRACT

"BUTTON PANEL FOR ELEVATORS, LIFTS OR SIMILAR MACHINERY", wherein said button has a new functional shape in such way that its four parts fit together perfectly and also fits with the elevator panel that may be put together with it.

5 Claims, 6 Drawing Sheets

BUTTON PANEL FOR ELEVATORS, LIFTS, AND SIMILAR MACHINERY

This utility patent relates to a: "BUTTON PANEL FOR ELEVATORS, LIFTS OR SIMILAR MACHINERY", and in particular to a button panel containing push buttons within its panel or board which have a new functional shape that enables them to fit with great accuracy; it is simple and safe to put it together, there is no need to use any fastening means such as screws, rivets, clinches, adhesives, etc.

Up to the moment, several different types of buttons that are fastened to the panel by screws have been used for button panels for elevators. Now, we hereby present a button that has such shape that can be put together within the panel of the elevator or lift without any fastening means. In such way that anyone can easily remove, change or take said parts from the back of the panel.

Thus, the main aim of this utility patent is to present a: "BUTTON PANEL FOR ELEVATORS, LIFTS OR SIMILAR MACHINERY", the kind of panel button that is made up of the combination of four pieces that fit together properly, namely: the casing, the inner section, the outer section and the printed circuit. This panel button is characterized by the rectangular shape of its casing with the matching sliding flaps located on the largest opposite sides which fit together with the inner section. Said inner section has an empty rectangular shape that has slots on two of its opposite largest laterals for said casing to be mounted; and to match with its back section, it has at least four flaps connected with the micro switches of the printed circuit; said outer section telescopically contains the said inner section an also has a rectangular empty shape which is slightly bigger than the inner section, and has on its outer opposite laterals several bumps of an oval shape that fit together with the respective oval shaped drillings on the elevator panel; said printed circuit has a rectangular shape, and with correspondence with its shorter lateral sides, it has projecting edges that fit together with the back section of the said outer section.

A secondary element of this Utility Patent is characterized by said casing that has over its surface alphanumeric characters.

Another secondary element of this Utility Patent is the fact that said casing has on its surface Braille characters.

Another secondary element of this Utility Patent is the fact that said casing has on its surface graphic designs.

Another secondary element of this Utility Patent is the fact that said casing has on its surface lighting means.

For a better understanding of this Utility Patent and of the shape the same has to have, several drawings will be attached as follows.

And FIGS. 7 to 14 illustrate other eight variants of drillings that may be applied to said panel button.

In said figures there have been established several alphanumeric references that represent the following:

1.—The casing.
1*a*.—Flaps.
2.—Inner section.

2*a*.—Bumps.
2*b*.—Projecting contact.
3.—Inner section.
3*a*.—Oval bumps.
4.—Printed circuit.
4*a*.—Projecting edges
5.—Plate with embossed letters.
5*a*.—Oval drillings.
6.—Embossed letters.
7.—Ornamental drillings.
8.—Central empty area.
9.—First plate with ornamental drilling.
10.—Second plate with ornamental drilling.

Herein after you will find a detailed explanation of how this Utility Patent is constituted making reference to the numeration herein above established for each part.

Figure 1:
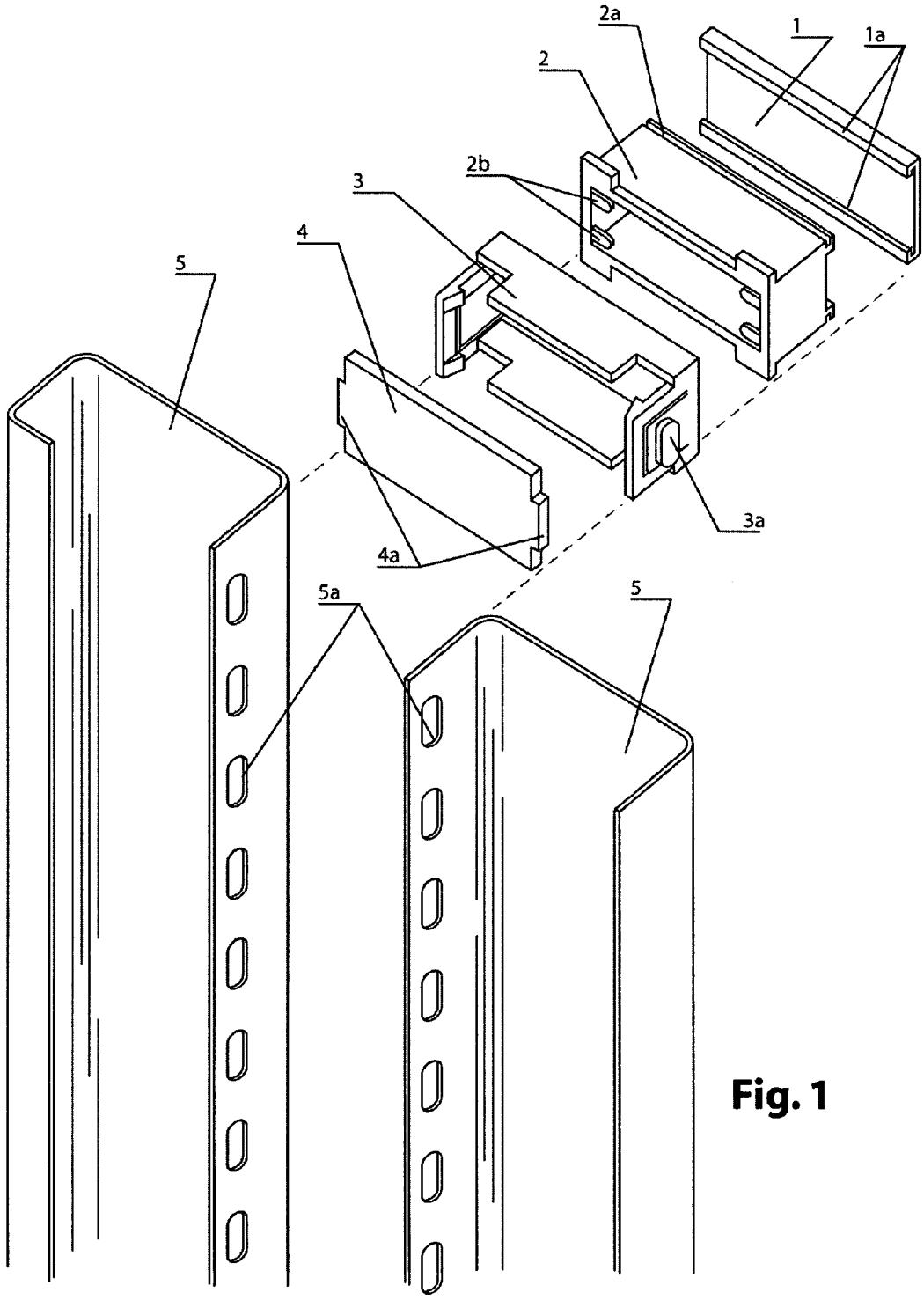
FIG. 1, illustrates an exploded perspective view of the back part of the panel button.
Figure 2:
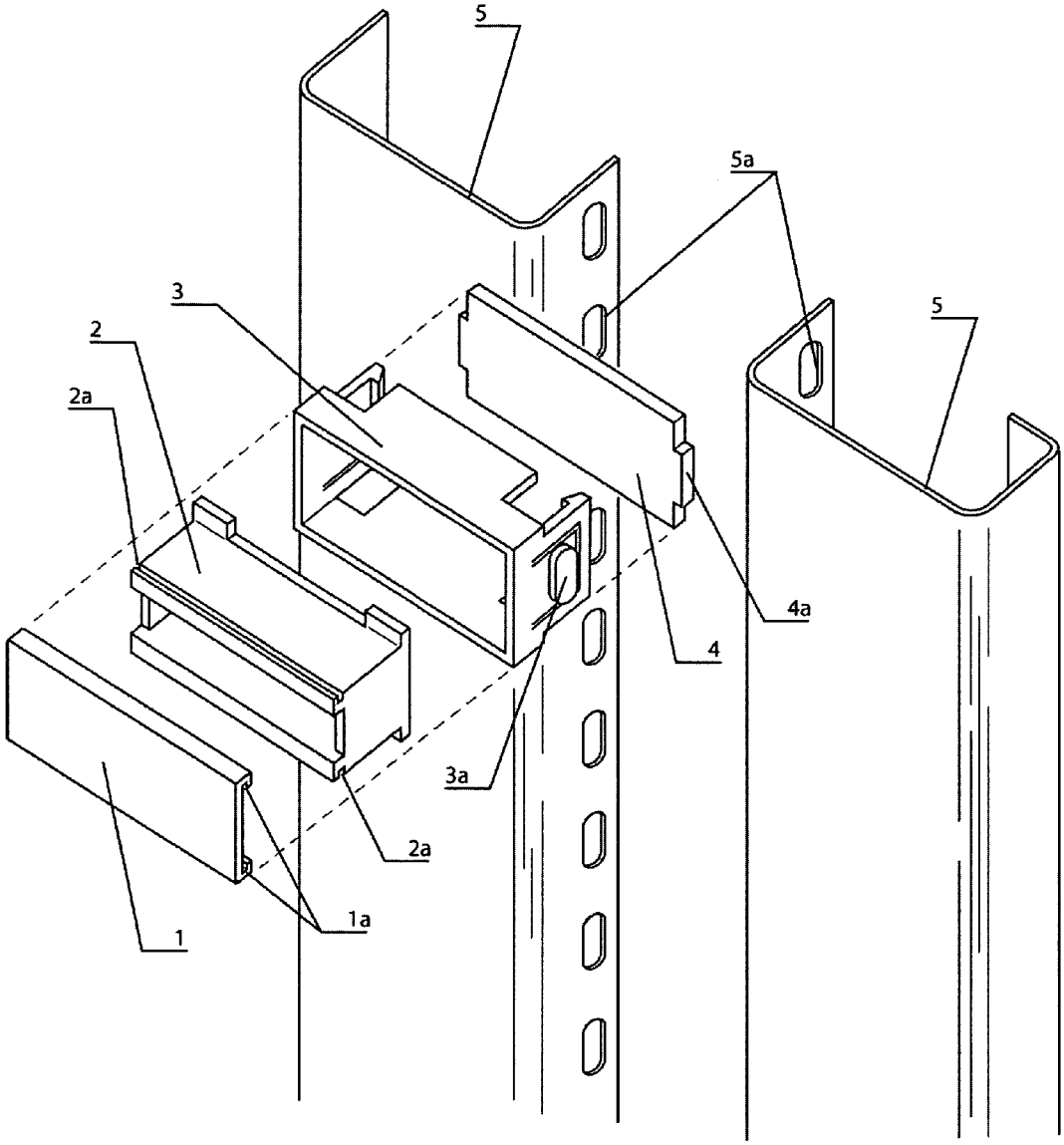
FIG. 2, illustrates an exploded perspective view of the front part of the panel button.

As you can appreciate in FIGS. 1 and 2 the button of said panel button is made up of several latching means, with at least four main constituents, namely: the casing (1), the inner section (2), the outer section (3) and the printed circuit (4).

Said casing (1) has a rectangular shape on which surface the messages will be placed, that can be either alphanumeric, Braille or graphic signs, etc.; those messages being lightened or not. This casing (1) has several flaps (1*a*) which coincide with said casing's larger opposite sides, to enable said inner section (2) to slide thereon.

Said inner section (2) has an empty rectangular shape that has bumps (2*a*) on two of its larger opposite laterals to enable the mounting of said casing (1), and it coincides with its upper section with at least four projecting contacts (2*b*) to make contact with the micro switches that the printed circuit (4) may have and to activate them.

Said outer section (3) also has an empty rectangular shape slightly bigger than the inner section (2), in order to enable each part to telescopically fit with each other. Said outer section (3) has in its opposite outer lateral sides several oval bumps (3*a*) that fit together with each corresponding oval drilling (5*a*) that the panel button for the elevator has.

Said printed circuit (4) has a rectangular shape, and it coincides with its shorter lateral sides with its projecting edges (4*a*) in order to fit together with the back of said outer section (3).

Figure 3:
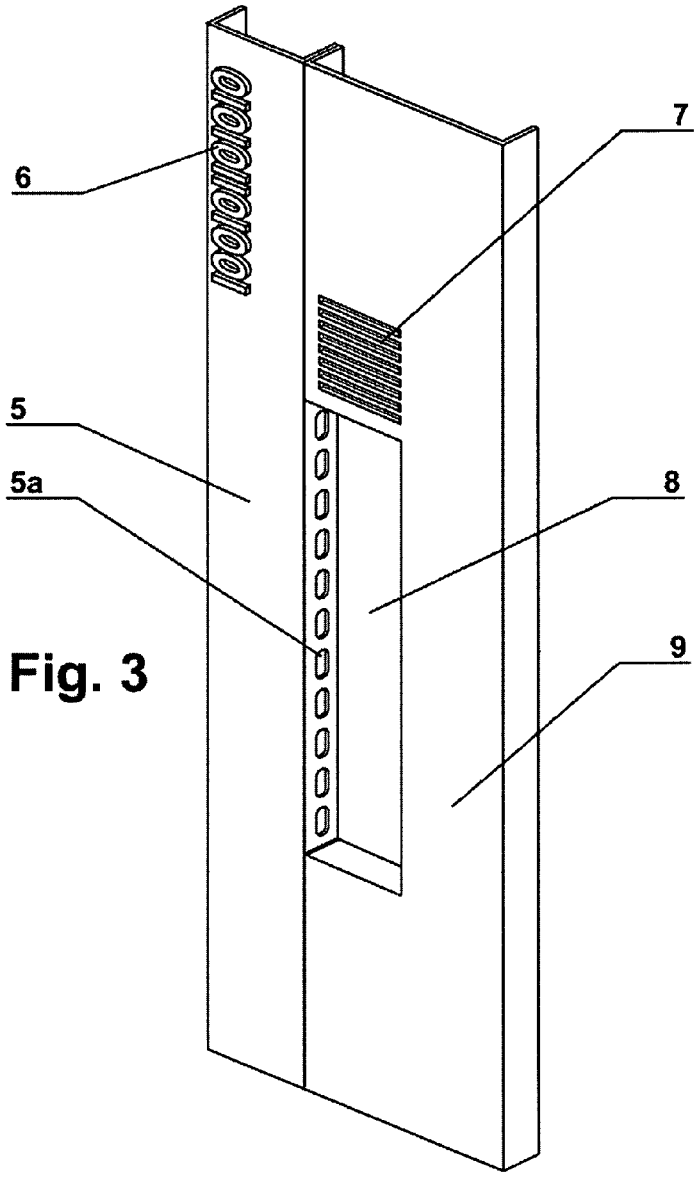
FIG. 3, illustrates a perspective of the front of the panel button.
Figure 4:
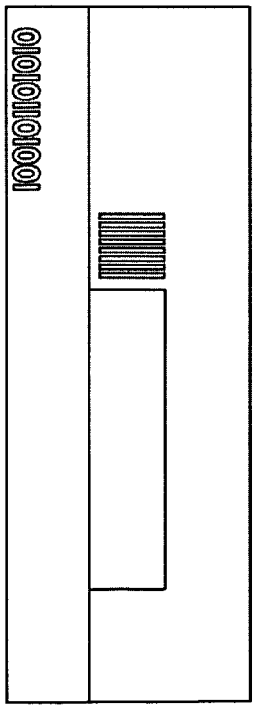
FIG. 4, illustrates the front of the panel button.
Figure 5:
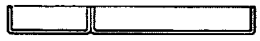
FIG. 5, illustrates the panel button seen from the top.

As you can appreciate on FIGS. 3, 4 and 5, this panel button is made up of a laminar material in which the remainder of de dimensions is predominant over the thickness.

Said panel is made up of the lateral union of at least two parts that can be put together, namely: a pole or a vertical plate with embossed letters (5) and a pole or first plate with ornamental drillings (9). Said union is formed with a central rectangular empty area (8) in which the buttons will be placed to command the elevator, lift or similar machinery in which this kind of panels will be installed.

Said pole or vertical plate (5) has a frontal rectangular shape of a minor horizontal base and a U-shaped profile (see FIG. 5.). And it presents over its surface engravings or embossed letters (6) with instruction letterings. And on its U-shaped profile flanks it has several oval drillings (5*a*).

Said pole or first plate with drillings (9) has an horizontal U-shaped front and a U-shaped profile (see FIG. 5). And it has on its surface several ornamental drillings (7).

Figure 6:
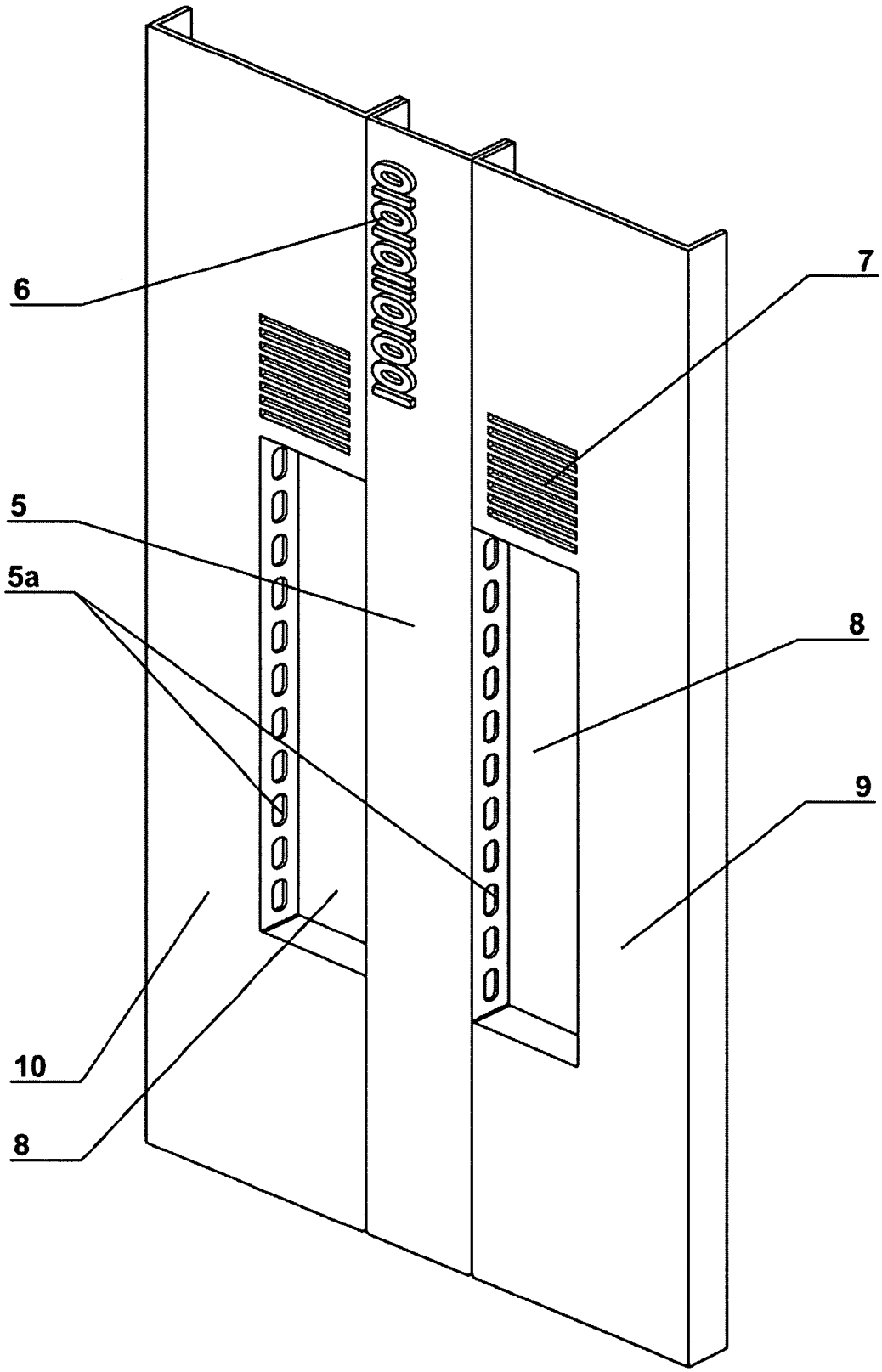
FIG. 6, illustrates a frontal perspective view of one of the variants of the panel button.
Figure 7:
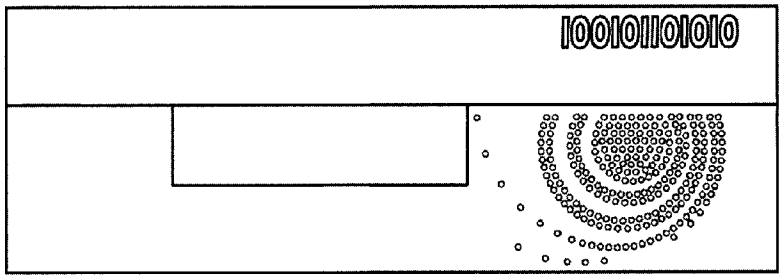
Figure 8:
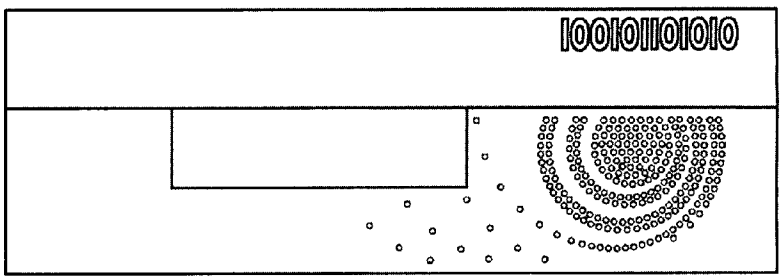
Figure 9:
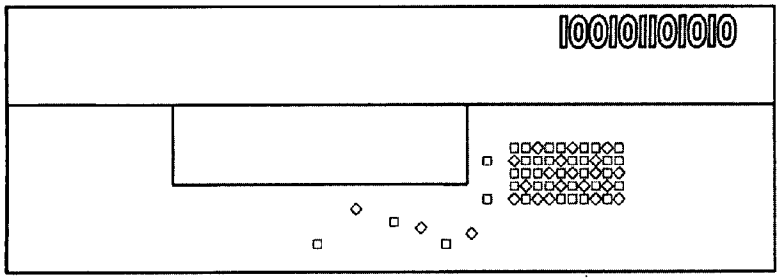
Figure 10:
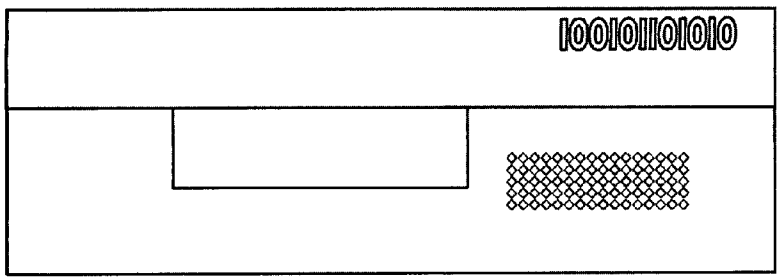
Figure 11:
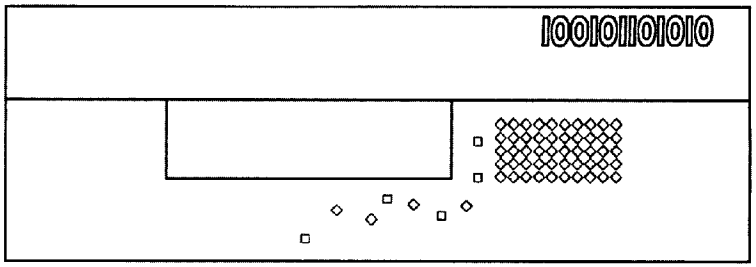
Figure 12:
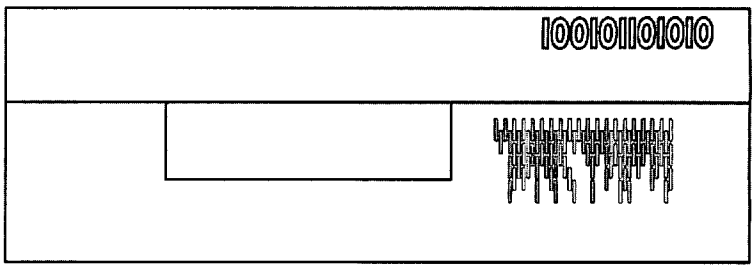
Figure 13:
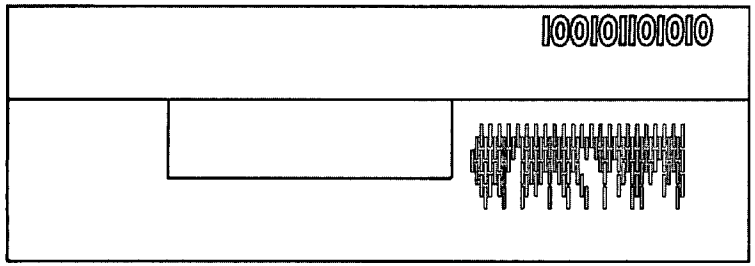
Figure 14:
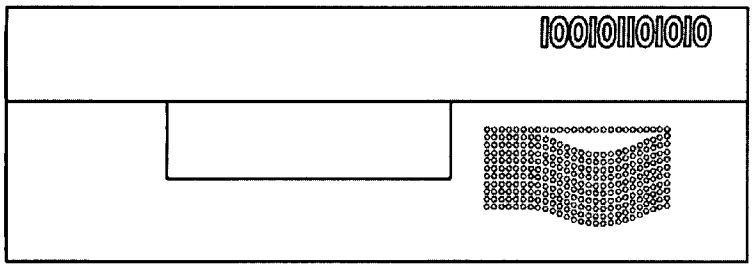

Whilst the FIG. 6. illustrates a variant of this model, in which another pole or second drilled plate (10) is added to the other side of the pole or vertical plate (5), the shape of said added pole or second drilled plate (10) is an specular image of the pole or first drilled plate (9); this variant can be applied in the case that this panel requires more buttons to command the elevator, lift or similar machinery.

Herein below you will find the description of the execution of the figures, making clear that the same have been represented by a graphic in which we can appreciate the front of the model and only the upper part of the pole or first plate with drillings (9) with the different ornamental shapes.

In a first display figure (see FIG. 7) of this Utility Patent you can appreciate an ornamental drilling constituted by several little circular pass-through holes that are set out in a spiral shape.

In a second display figure (see FIG. 8) of this Utility Patent you can appreciate an ornamental drilling constituted by several little circular pass-through holes that are set out in a spiral shape that expand and cover a bigger surface in comparison to the previous figure.

In a third display figure (see FIG. 9) of this Utility Patent you can appreciate an ornamental drilling constituted by several little quadrangular pass-through holes that are set out in a rectangular shape and underneath said holes you will find smaller quadrangular pass-through holes more dispersed from each other and that expand up to the middle of said plate.

In a fourth display figure (see FIG. 10) of this Utility Patent you can appreciate an ornamental drilling constituted by several little quadrangular pass-through holes that are set out in a rectangular shape that expand and cover a bigger surface in comparison to the previous figure.

In a fifth display figure (see FIG. 11) of this Utility Patent you can appreciate an ornamental drilling constituted by several little quadrangular pass-through holes that are set out in a rectangular shape and underneath said holes you will find smaller quadrangular pass-through holes more dispersed from each other and that expand up to the bottom of said plate.

In a sixth display figure (see FIG. 12) of this Utility Patent you can appreciate an ornamental drilling constituted by several rectangular drillings or holes set out horizontally, of different length, located one next to the other relatively.

In a seventh display figure (see FIG. 13) of this Utility Patent you can appreciate an ornamental drilling constituted by several rectangular drillings or holes set out horizontally, of different length, located one next to the other relatively that expand and cover a bigger surface in comparison to the previous figure.

In an eighth display figure (see FIG. 14) of this Utility Patent you can appreciate an ornamental drilling constituted by several circular drillings or holes set out in a wave shape.

What is claimed is:

1. "BUTTON PANEL FOR ELEVATORS, LIFTS OR SIMILAR MACHINERY", said button panel comprising a combination of at least four main parts, namely: the casing, the inner section, the outer section and the printed circuit; CHARACTERIZED BY the rectangular shape of said casing, and its correspondence with its larger opposite sides with flaps that fit together with the inner section for it to slide thereto; said inner section has a rectangular empty shape with slots on both of its larger opposite laterals to enable the mounting of said casing, and in correspondence with its back part, it has at least four projecting contacts in contact with the micro switches that the printed circuit may have; said outer section telescopically contains the said printed circuit and also has a rectangular empty shape slightly bigger than the inner section, and presents in its opposite external laterals several oval bumps that fit together in correspondence with the oval drillings that the panel button for the elevator has; said printed circuit has a rectangular shape, and it is in correspondence with the shorter lateral sides that have projecting edges that fit together with the back part of said inner section.

2. "BUTTON PANEL FOR ELEVATORS, LIFTS OR SIMILAR MACHINERY", as claimed in claim 1, wherein said casing has on its surface alpha numeric characters.

3. "BUTTON PANEL FOR ELEVATORS, LIFTS OR SIMILAR MACHINERY", as claimed in claim 1, wherein said casing has on its surface Braille characters.

4. "BUTTON PANEL FOR ELEVATORS, LIFTS OR SIMILAR MACHINERY", as claimed in claim 1, wherein said casing has on its surface graphic designs.

5. "BUTTON PANEL FOR ELEVATORS, LIFTS OR SIMILAR MACHINERY", as claimed in claim 1, wherein said casing has lightning means.

* * * * *